US005591075A

United States Patent [19]

Chang

[11] Patent Number: 5,591,075

[45] Date of Patent: Jan. 7, 1997

[54] GRINDING MACHINE WITH A FIREPROOF DUST-COLLECTING SYSTEM

[76] Inventor: Chien-Yen Chang, No. 8, Alley 130, Lane 195, Chung-Hsiao Rd., Yung-Kang City, Tainan Hsien, Taiwan

[21] Appl. No.: 524,403

[22] Filed: Sep. 6, 1995

[51] Int. Cl.[6] ..... B24B 55/02

[52] U.S. Cl. ..... 451/451; 451/453; 451/455; 451/178

[58] Field of Search ..... 451/178, 170, 451/190, 194, 451, 452, 453, 455, 457

[56] References Cited

U.S. PATENT DOCUMENTS

| | | | |
|---|---|---|---|
| 1,230,462 | 6/1917 | Buerk et al. | 451/178 |
| 1,312,121 | 8/1919 | Johnson | 451/455 |
| 1,372,033 | 3/1921 | Mairschke et al. | 451/451 |
| 1,480,601 | 1/1924 | Dobyne | 451/194 |
| 1,958,001 | 5/1934 | Heim | 451/190 |
| 1,991,445 | 2/1935 | Brostrom | 451/455 |
| 2,069,395 | 2/1937 | Tautz | 451/455 |
| 2,280,498 | 4/1942 | Morris | 451/178 |
| 2,549,529 | 4/1951 | Sandlin | 451/453 |
| 2,836,937 | 6/1958 | Cornrlius | 451/177 |
| 3,098,332 | 7/1963 | Sutton | 451/453 |
| 3,460,294 | 8/1969 | Stumpf | 451/453 |
| 3,543,446 | 12/1970 | Kilian | 451/194 |
| 4,555,874 | 12/1985 | Chung | 451/453 |
| 4,578,907 | 4/1986 | Cayley et al. | 451/451 |
| 4,910,925 | 3/1990 | Longuet et al. | 451/453 |

FOREIGN PATENT DOCUMENTS

| | | | |
|---|---|---|---|
| 506839 | 10/1954 | Canada | 451/453 |
| 776904 | 11/1980 | U.S.S.R. | 451/453 |

*Primary Examiner*—Bruce M. Kisliuk
*Assistant Examiner*—Derris H. Banks
*Attorney, Agent, or Firm*—Knobbe, Martens, Olson & Bear

[57] ABSTRACT

A grinding machine includes a casing with a top plate unit, two grinding units installed on the top plate unit, and a driving unit for activating the grinding units. The top plate unit has a dust inlet slot formed therethrough so as to permit dropping of dust from the corresponding grinding unit into the dust inlet slot. The casing has two side chambers communicated with the dust inlet slots, and a middle chamber which is located between the side chambers and which receives a filtering unit therein. A dust-collecting chamber is located in a bottom portion of the casing and is communicated with the side chambers and the middle chamber. An exhaust fan unit is disposed in the middle chamber and is located over the filtering unit to draw dust from the dust-collecting chamber in order to discharge the same from the casing. Two fireproof dust-guiding units are disposed within the side chambers respectively so as to guide dust from the grinding units to the dust-collecting chamber through the side chambers and so as to prevent fire sparks from contacting a filtering sheet of the filtering unit.

3 Claims, 5 Drawing Sheets

GRINDING MACHINE WITH A FIREPROOF DUST-COLLECTING SYSTEM

BACKGROUND OF THE INVENTION

1. Field of the Invention

The invention relates to a grinding machine, more particularly to a grinding machine with a fireproof dust-collecting system.

2. Description of the Related Art

Referring to FIGS. 1 and 2, a conventional grinding machine 10 includes a casing 12 with a top plate unit 12A disposed at a top end portion of the casing 12, two grinding units or grinding wheels 11 installed on two side portions of the top plate unit 12A, a driving unit 12B for activating the grinding units 11, a dust-collecting chamber 15 disposed in a lower end portion of the casing 12, and a filtering unit 16 installed in the casing 12 under the top plate unit 12A. As illustrated, each of the side portions of the top plate unit 12A has a dust inlet slot 111 formed therethrough so as to permit dropping of dust from a corresponding one of the grinding units 11 into the dust inlet slot 111. Each of the grinding units 11 is further provided with two shielding sheets 13, 14 which facilitate dropping of dust into the dust inlet slot 111 of the casing 12. A plurality of air discharge outlets 122 are located below the top plate unit 12A.

Some of the drawbacks resulting from the use of the conventional grinding machine 10 are as follows:

(I) During the grinding operation, sparks of fire are generated. Since the filtering sheets used in the filtering unit 16 are generally made from flammable material, such as non-woven fabrics, the fire sparks may accidentally ignite the filtering sheets.

(II) Only a particular size of grinding wheel can be employed with the grinding units 11, thereby limiting undesirably the range of use of the grinding machine 10.

SUMMARY OF THE INVENTION

An object of this invention is to provide a grinding machine with a fireproof dust-collecting system.

Another object of this invention is to provide a grinding machine in which grinding wheels of different diameters can be installed.

Accordingly, a grinding machine of this invention includes a casing with a top plate unit disposed at a top end portion thereof, two grinding units installed on two side portions of the top plate unit, a driving unit for activating the grinding units, and a filtering unit installed in the casing. Each of the side portions of the top plate unit has a dust inlet slot formed therethrough so as to permit dropping of dust from a corresponding one of the grinding units into the dust inlet slot. The casing has two vertical side walls, and two vertical partitions located between the side walls, two side chambers which are located in two sides of the casing under the side portions of the top plate unit and which are respectively defined between one of the side walls and one of the partitions. A middle chamber is defined between the partitions and receives the filtering unit in a lower portion thereof. A dust-collecting chamber is located in a bottom end portion of the casing and is situated under and communicated with the side chambers and the middle chamber. Two dust-guiding units are disposed within the side chambers respectively so as to guide dust from the grinding units to the dust-collecting chamber through the side chambers. An exhaust fan unit is disposed in the middle chamber and is located over the filtering unit so as to draw dust from the dust-collecting chamber in order to discharge the dust from the casing. Each of the dust guiding units includes a vertical row of inclined fireproof first guide fins which are fixed in a corresponding one of the side chambers and which extend from and incline downwardly from the corresponding side wall, and a vertical row of inclined fireproof second guide fins which are fixed in the corresponding one of the side chambers and which extend from and incline downwardly from the corresponding partition in such a manner that each of the first guide fins has a lower end located between an adjacent pair of the second guide fins, while each of the second guide fins has a lower end located between an adjacent pair of the first guide fins.

In the preferred embodiment, the driving unit includes a motor which is installed on the top plate unit and which has a motor shaft and a motor casing with an end surface that has several threaded holes. Each of the grinding units includes a grinding wheel sleeved fixedly on the motor shaft and located over the corresponding inlet slot of the top plate unit, and a mounting frame which is fixed on the top plate unit and which has a vertical mounting plate with a shaft hole for extension of the motor shaft. The mounting plate has several vertical slots formed therethrough. The grinding unit further has several lock bolts respectively extending through the vertical slots of the mounting plates to engage the threaded holes of the motor casing so as to position the grinding wheels relative to the casing. When all of the locking bolts are loosened from the motor casing, the locking bolts can be moved along the vertical slots of the mounting plates so as to adjust position of the grinding wheels relative to the casing.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
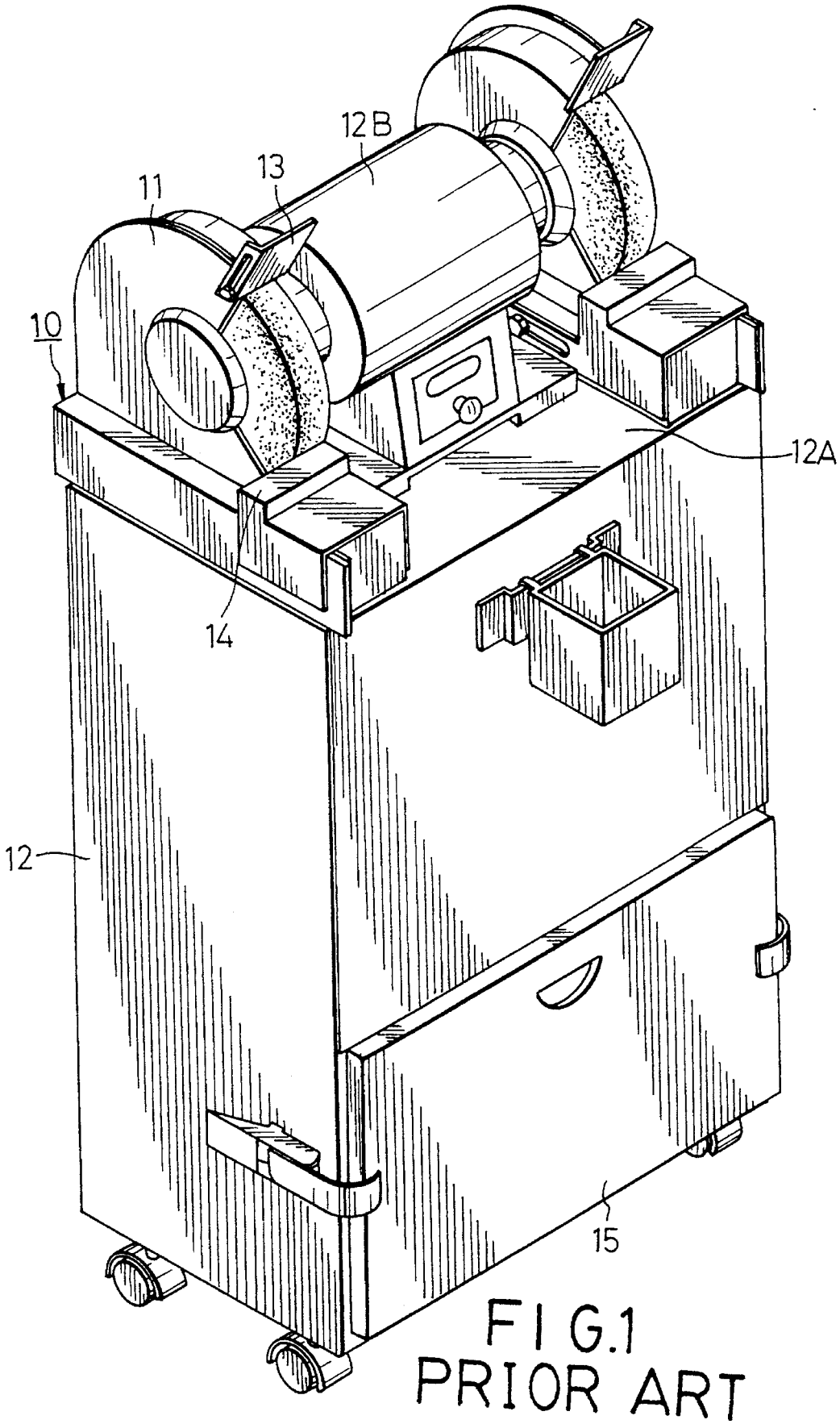
FIG.1 PRIOR ART
FIG. 1 is a perspective view of a conventional grinding machine.
Figure 2:
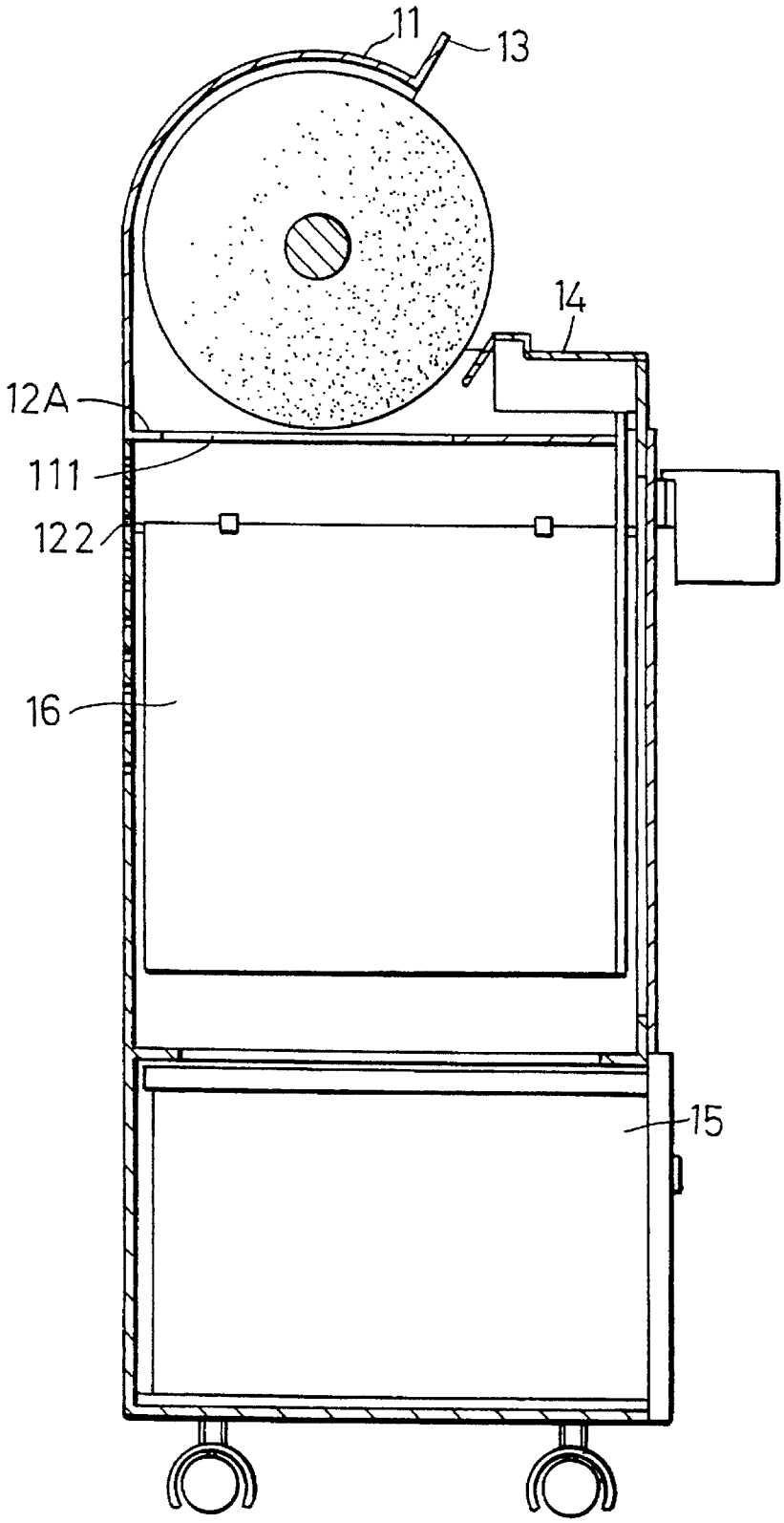
FIG.2 PRIOR ART
FIG. 2 is illustrates a sectional view of the conventional grinding machine of FIG. 1.
Figure 3:
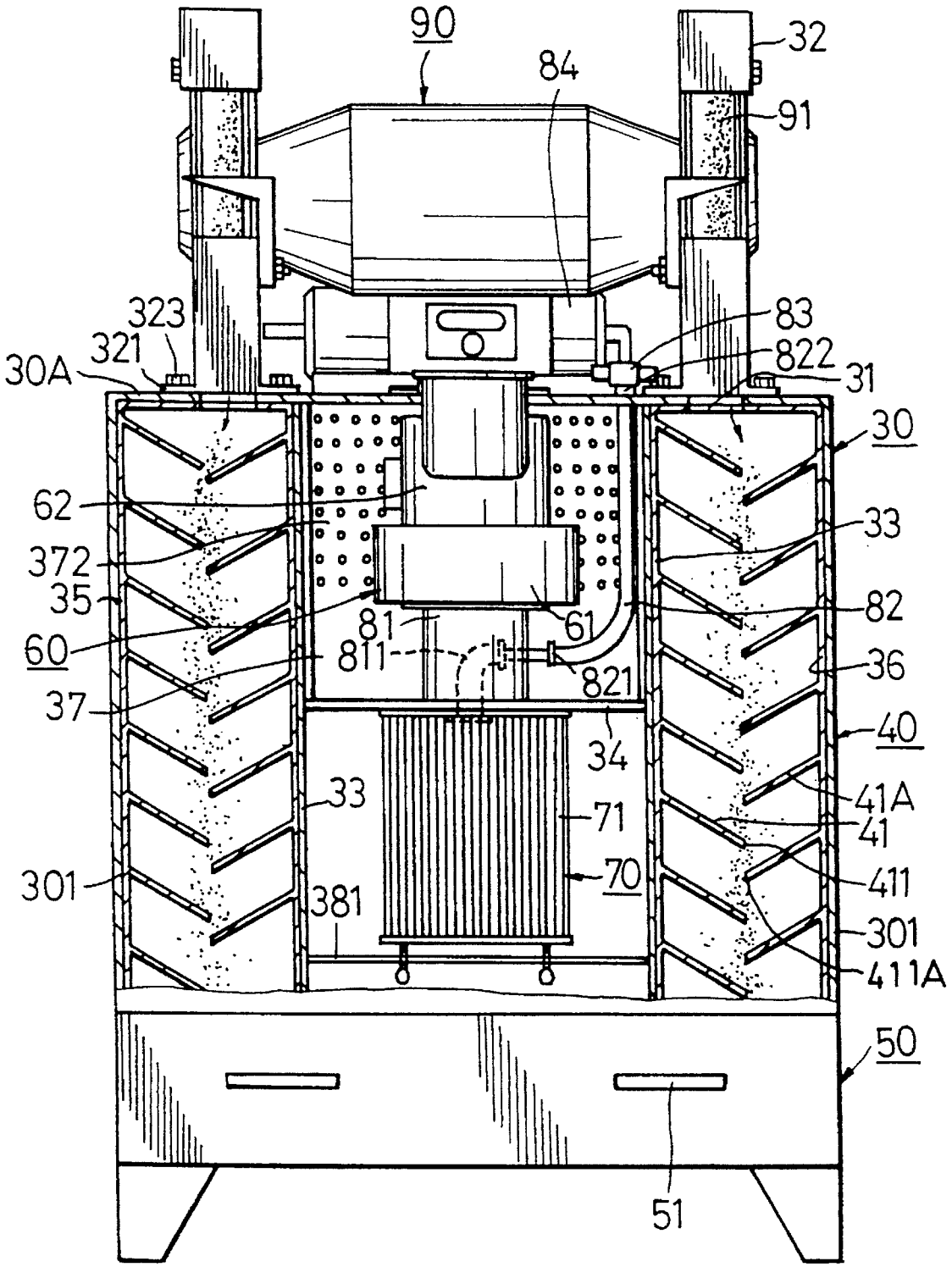
FIG. 3 is a partially sectional view of the preferred embodiment of a grinding machine of the present invention.

Referring to FIG. 3, the preferred embodiment of a grinding machine of this invention is shown to include an upright rectangular casing 30 with a top plate unit 30A, two grinding units or grinding wheel 32 installed on two side portions of the top plate unit 30A, two dust-guiding units 40, a dust-collecting chamber 50, an exhaust fan unit 60, a filtering unit 70, and a driving unit 90 for activating the grinding wheels 32.

As illustrated, each of the side portions of the top plate unit 30A has a dust inlet slot 31 formed therethrough so as to permit dropping of dust from a corresponding one of the grinding units 32 into the dust inlet slot 31. The casing 30 has two vertical side walls 301, a rear side wall with a plurality of discharge outlets 372 formed therethrough, and two partitions 33 located between the side walls 301, two side chambers 35, 36 which are located in two sides of the casing 10 under the side portions of the top plate unit 30A and which are respectively defined between one of the side walls 301 and one of the partitions 33. A middle chamber 37 is defined between the partitions 33 and receives the filtering unit 70 in a lower portion thereof. The dust-collecting chamber 50 is located in a bottom end portion of the casing 30 and is situated under and communicated with the side chambers 35, 36 and the middle chamber 37. A drawer-like dust bin is disposed slidably in the dust-collecting chamber 50. A handle 51 is attached to the dust bin to facilitate handling thereof. The dust-guiding units 40 are disposed within the side chambers 35, 36 respectively so as to guide dust from the grinding wheels 32 to the dust-collecting chamber 50 through the side chambers 35, 36.

The exhaust fan unit 60 is disposed in the middle chamber 37 and is located over the filtering unit 70 so as to draw dust from the dust-collecting chamber 50 in order to discharge the dust from the casing 30 via the discharge outlets 372 of the rear side wall. The exhaust fan unit 60 includes a fan 61, and a driving motor 62 fixed in the middle chamber 37 and connected to the fan unit 60 so as to rotate the same. Each of the dust-guiding units 40 includes a vertical row of inclined fireproof first guide fins 41 which are fixed in a corresponding one of the side chambers 35, 36 and which extend from and incline downwardly from the corresponding partition 33, and a vertical row of inclined fireproof second guide fins 41A which are fixed in the corresponding one of the side chambers 35, 36 and which extend from and incline downwardly from the corresponding side wall 35, 36. Each of the first guide fins 41 has a lower end 411 located between an adjacent pair of the second guide fins 41A, while each of the second guide fins 41A has a lower end 411A located between an adjacent pair of the first guide fins 41.

Figure 5:
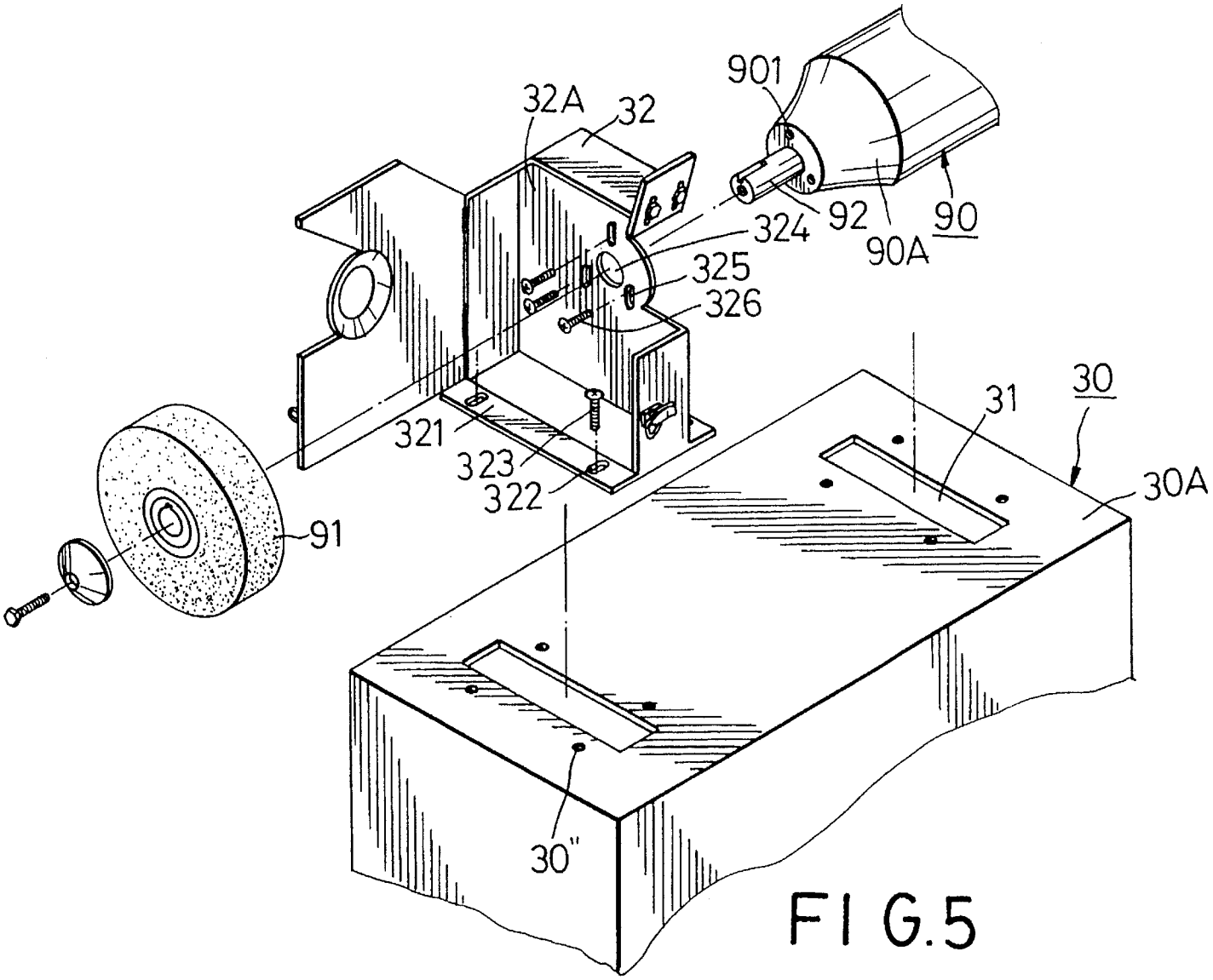
FIG. 5 illustrates an exploded view of a grinding unit of the preferred embodiment.

Referring to FIG. 5, in the preferred embodiment, the driving unit 90 includes a motor which is installed on the top plate unit 30A and which has a motor shaft 92 and a motor casing 90A with an end surface that is formed with several threaded holes 901. Each of the grinding units includes a grinding wheel 91 sleeved fixedly on the motor shaft 92 and located over the corresponding one of the inlet slots 31 of the top plate unit 30A, and a mounting frame which is fixed on the top plate unit 30A and which has a vertical mounting plate 32A formed with a shaft hole 324 for extension of the motor shaft 92 therethrough, and several vertical slots 325. Each of the grinding units further includes several lock bolts 326 respectively extending through the vertical slots 325 of the mounting plates 32A to engage the threaded holes 901 of the motor casing 90A so as to position the grinding wheels 91 relative to the casing 30. When all of the locking bolts 326 are loosened from the motor casing 90A, the locking bolts 326 can be moved along the vertical slots 325 of the mounting plates 32A so as to adjust position of the grinding wheels 91 relative to the casing 30.

Note that each of the mounting frames has two elongated horizontal flanges 321 extending outwardly from a lower end thereof. The flanges 321 are provided with transverse slots 322 so that the fastening screws 323 can extend therethrough to engage in the threaded holes 30" of the top plate unit 30A. Accordingly, adjustment of the position of the lower portion of the mounting plates 32A relative to the dust inlet slot 31 can be achieved.

Figure 4:
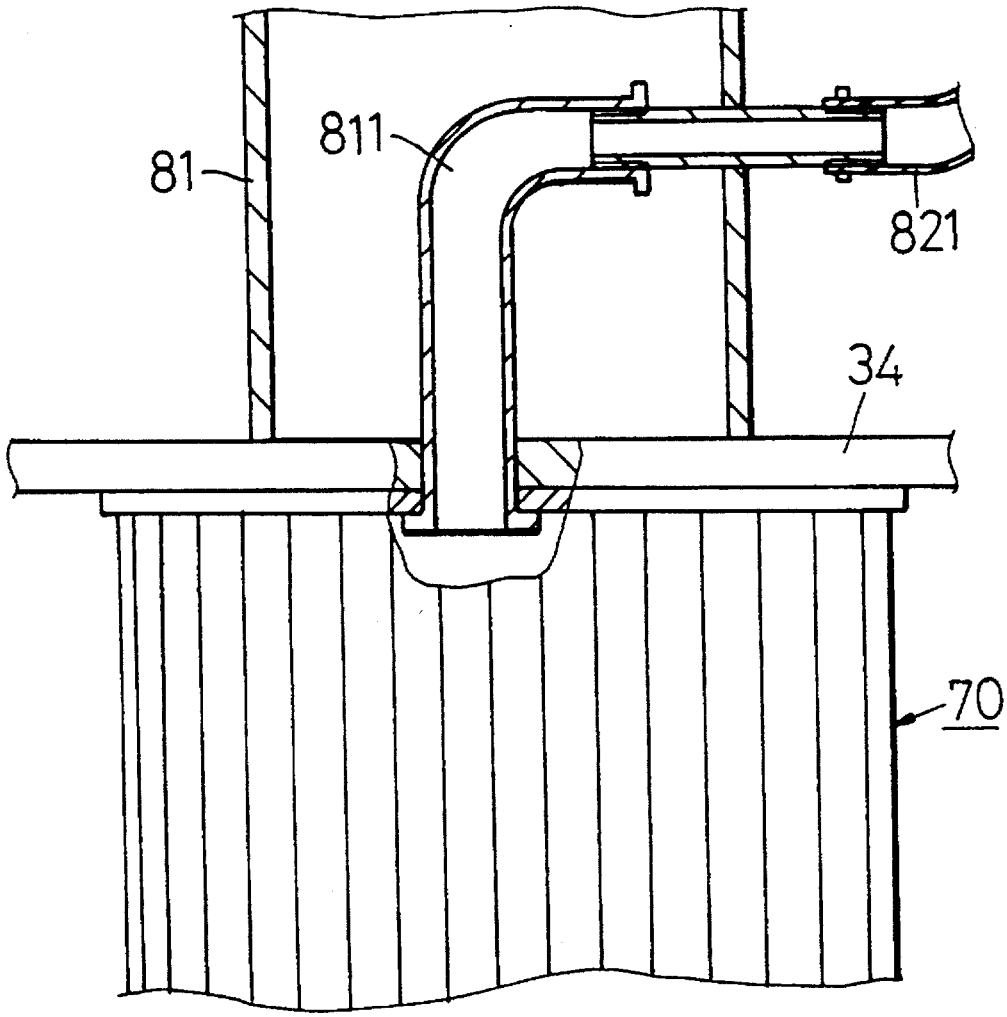
FIG. 4 illustrates how a filtering unit is connected to a compressed air source in accordance with the preferred embodiment.

Referring to FIGS. 3 and 4, in the preferred embodiment, a flexible hollow bag 81 interconnects the filtering unit 70 and the exhaust fan unit 60. The upper and lower portions of the filtering unit 70 are mounted respectively and threadedly to the horizontal mounting plates 381, 34 of the middle chamber 37 so that replacement of the filtering sheets 71 can be achieved with ease. The grinding machine further includes a compressed air source 84 installed on the top plate unit 30A and equipped with a nozzle 83 connected to the filtering unit 70 by a piping that is constituted by a flexible pipe 821 and an L-shaped connecting tube 811 so as to spray compressed air from the compressed air source 84 to the filtering unit 70, thereby cleaning dust from the outer surface of the filtering unit 70. The compressed air source 84 is provided with a release valve 822 for controlling the supply of compressed air therefrom.

From the above explanation, it can be appreciated that grinding wheels of different diameters can be fixed to the motor shaft 92. During the grinding operation, sparks of fire are shielded by the first and second guide fins 41, 41A so that the flammable filtering sheets are prevented from catching fire.

With the present invention thus explained, it is obvious to those skilled in the art that various modifications and variations can be made without departing from the scope and spirit thereof. It is therefore intended that the invention be limited only as in the appended claims.

I claim:

1. A grinding machine including a casing with a top plate unit disposed at a top end portion of said casing, two grinding units installed on two side portions of said top plate unit of said casing, a driving unit for activating said grinding units, and a filtering unit installed in said casing, wherein the improvement comprises:

each of said side portions of said top plate unit has a dust inlet slot formed therethrough so as to permit dropping of dust from a corresponding one of said grinding units into said dust inlet slot, said casing having two vertical side walls, two vertical partitions located between said side walls, two side chambers which are located in two sides of said casing under said two side portions of said top plate unit and which are respectively defined between one of said side walls and one of said partitions, a middle chamber defined between said partitions and receiving said filtering unit in a lower portion thereof, a dust-collecting chamber located in a bottom end portion of said casing and situated under and communicated with said side chambers and said middle chamber, two dust-guiding units disposed within said side chambers respectively so as to guide dust from said grinding units to said dust-collecting chamber through said side chambers, and an exhaust fan unit disposed in said middle chamber and located over said filtering unit so as to draw dust from said dust-collecting chamber in order to discharge dust from said casing, each of said dust-guiding units including a vertical row of inclined fireproof first guide fins fixed in a corresponding one of said side chambers and extending from and inclining downwardly from a corresponding one of said partitions, and a vertical row of inclined fireproof second guide fins fixed in the corresponding one of said side chambers and extending from and inclining downwardly from a corresponding one of said side walls in such a manner that each of said first guide fins has a lower end located between an adjacent pair of said second guide fins, while each of said second guide fins has a lower end located between an adjacent pair of said first guide fins.

2. A grinding machine as claimed in claim 1, wherein said driving unit includes a motor which is installed on said top plate unit and which has a motor shaft and a motor casing that has an end surface with several threaded holes formed therein, each of said grinding units including a grinding wheel sleeved fixedly on said motor shaft and located over a corresponding one of said inlet slots of said top plate unit, and a vertical mounting plate fixed on said top plate unit and having several vertical slots formed through said mounting plate, and several lock bolts respectively extending through said vertical slots of said mounting plates to engage said threaded holes of said motor casing so as to position said grinding wheel relative to said casing, whereby, when said locking bolts are loosened from said motor casing, said locking bolts can be moved along said vertical slots of said mounting plates so as to adjust position of said grinding wheels relative to said casing.

3. A grinding machine as claimed in claim 1, wherein a compressed air source is installed on said top plate unit and includes a nozzle directed to said filtering unit so as to spray compressed air from said compressed air source to said filtering unit, thereby cleaning dust from an outer surface of said filtering unit.

* * * * *